US007523588B2

(12) United States Patent
Katz

(10) Patent No.: US 7,523,588 B2
(45) Date of Patent: Apr. 28, 2009

(54) ENTRYWAY PROTECTOR

(75) Inventor: Edward R. Katz, Cartersville, GA (US)

(73) Assignee: Marquis, Inc., Cartersville, GA (US)

( * ) Notice: Subject to any disclaimer, the term of this patent is extended or adjusted under 35 U.S.C. 154(b) by 926 days.

(21) Appl. No.: 11/063,061

(22) Filed: Feb. 22, 2005

(65) Prior Publication Data

US 2005/0138873 A1 Jun. 30, 2005

Related U.S. Application Data

(63) Continuation-in-part of application No. 10/781,527, filed on Feb. 17, 2004, now abandoned, which is a continuation-in-part of application No. 10/090,678, filed on Mar. 5, 2002, now Pat. No. 6,718,706, which is a continuation-in-part of application No. 09/695,885, filed on Oct. 25, 2000, now Pat. No. 6,381,910, which is a continuation-in-part of application No. 09/580,097, filed on May 30, 2000, now Pat. No. 6,216,396, which is a continuation of application No. 09/223,985, filed on Dec. 31, 1998, now Pat. No. 6,128,862.

(51) Int. Cl.
*E04D 13/18* (2006.01)

(52) U.S. Cl. ..... 52/173.2; 52/204.1; 52/2.12

(58) Field of Classification Search ..... 52/717.01, 52/211, 2.12, 173.2, 204.1, 800.11, 800.16
See application file for complete search history.

(56) References Cited

U.S. PATENT DOCUMENTS 1,277,319 A * 8/1918 Joice ..... 52/582.1
3,064,320 A * 11/1962 Blaszkowski ..... 52/2.12
3,130,455 A * 4/1964 Borlenghi ..... 49/504
3,389,515 A * 6/1968 Hellebrand ..... 52/94
3,404,495 A * 10/1968 Simpson, Jr. ..... 52/58
4,328,273 A * 5/1982 Yackiw ..... 428/122
4,372,083 A * 2/1983 Hatzikelis et al. ..... 49/462
4,419,850 A * 12/1983 Butzen ..... 52/60
4,550,542 A * 11/1985 La See ..... 52/476
4,873,800 A * 10/1989 Frommelt et al. ..... 52/173.2
5,337,526 A * 8/1994 Hartman ..... 52/58
5,586,415 A * 12/1996 Fisher et al. ..... 52/58
6,216,408 B1 * 4/2001 Davidson ..... 52/300

* cited by examiner

*Primary Examiner*—Basil Katcheves
(74) *Attorney, Agent, or Firm*—Thomas, Kayden, Horstemeyer & Risley LLP

(57) ABSTRACT

The present invention is a entryway protector for use with elevator door jamb panels to protect the surfaces of the panels from sustaining damage from collisions with moving equipment, building materials and furniture. The entryway protector includes the main sections and an angled guide and a minor section which is attached at approximately a right angle. The entryway protector is constructed of a material that is sufficiently rigid to protect the elevator door jamb panel and also to remain in proper position. The entryway protector may be attached to the elevator door jamb panel by suction cups. Preferably the entryway protector is made at a height of approximately forty inches so that two entryway protectors are need for each elevator door jamb panel. Two entryway protectors can be attached together by one or more H clamps.

5 Claims, 3 Drawing Sheets

ENTRYWAY PROTECTOR

CROSS-REFERENCE TO RELATED APPLICATION

This is a continuation-in-part of U.S. patent application Ser. No. 10/781,527 filed Feb. 17, 2004, now abandoned which was a continuation-in-part of application Ser. No. 10/090,678 filed on Mar. 5, 2002, which issued as U.S. Pat. No. 6,718,706 on Apr. 13, 2004 which was a continuation-in-part of U.S. patent application Ser. No. 09/695,885 filed Oct. 25, 2000, which issued as U.S. Pat. No. 6,381,910 on May 7, 2002, which is a continuation-in-part of U.S. patent application Ser. No. 09/580,097, filed May 30, 2000, now U.S. Pat. No. 6,216,396 which is a continuation of patent application Ser. No. 09/223,985 filed on Dec. 31, 1998, now U.S. Pat. No. 6,128,862.

BACKGROUND OF THE INVENTION

1. Field of the Invention

The present invention relates to a protective device for protecting exposed entryways of elevators from the inadvertent contact and possible damage by furniture, equipment, construction materials and the like being moved in and out of elevators.

2. Description of Related Art

The relocation industry employs numerous devices and methods in order to provide the quickest, safest and most inexpensive move possible for their clients. Moving companies and related industries constantly develop, test and refine innovative products so that such a move is possible. For example, moving companies often utilize lifting devices that are easily movable through constricted spaces, such as door frames. These lifting devices can safely secure a heavy load and allow just a single person to navigate the load in and out of buildings. These devices also reduce the risk of injury to movers.

A typical office mover employs several individuals to load and unload furniture on and off moving equipment or move the furniture by hand. The moving equipment typically is pushed or pulled through the office, through the office doors, in to an elevator, out of the elevator, and through the building's front doors. This procedure is repeated, in reverse, to move the furniture into the new office space. Throughout this moving process, edges and corners of, for example, a hand truck or the furniture can inadvertently come in contact with walls, doors, and jambs, not only damaging the moving equipment and furniture, but also the walls, doors and jamb surfaces.

Similar to the moving process described above, customized construction in an office space can pose a similar risk to both the moving equipment and building materials, and the surfaces of the building's wall, doors and jambs. The expense of repairing damaged walls, doors and door jambs typically falls upon the building owner, the landlord or building management. Thus, movers and contractors rarely bring to the site protective pads to place minimize such damage to buildings to maintain a quality reputation. Thus, movers and contractors utilize moving equipment designed to avoid this type of damage.

One such product is the Spider Crane® used by Office Moving Systems of Atlanta, Ga. The Spider Crane® lifts full lateral files high enough to roll a specially designed steel dolly underneath the files. While the cabinet is held safely suspended, a member of the moving crew slides the steel dolly underneath the cabinet, which is then gently lowered. This type of device not only reduces injuries, but also enables the client to minimize down time since the Spider Crane® lifts a full file cabinet. Thus, the client need not unload the cabinets and pack the files in boxes. The proper use of this type of device also reduces the expense to the moving company of patching and painting walls damaged by moving the cabinets through the office versus when cabinets are moved in more traditional ways, such as by a two-wheel dolly or hand truck, where there is less control over the cabinets while they are moved in and out of the buildings.

Even with the best of care, there is always the risk of damage to property during the moving process. Damage is not confined to the items and products being moved, but can also be sustained by the office or residential structure itself which can be banged, dinged or scratched by the items or the moving equipment such as dollies and hand trucks. The transportation of construction materials through a building passageway also can cause damage, specifically damaging areas of narrowing in the passageway, which are typically at doorways and elevators. An inadvertent scrape can damage the paint, wallpaper and other building surface material.

U.S. patent application Ser. No. 10/781,527, filed on Feb. 17, 2004 discloses a superior entryway protector having a main section with cushioning material and a rigid sheet. The main section has a horizontal fold line with a sheet on each side of the fold line. A minor flap is connected to the main section by a line of stitching or a fold line. A securing system secures the entryway protector to the surfaces being protected. The invention of application Ser. No. 09/695,885 comprises two sections and a securing component. A main rectangular section is separated by a vertical line of stitching from a smaller section, or minor rectangular flap. The minor flap is further provided with a vertical line of stitching forming two minor flap components. Both the main section and the minor flap are also provided with at least one horizontal line of stitching. The vertical and horizontal lines of stitching provide fold lines for the device. U.S. patent application Ser. Nos. 10/781,527, 10/090,678, and 09/695,885 are hereby fully incorporated by reference.

In the manufacture and use of these devices of these two applications it was noted that certain modifications of the principal design could be improved on, or made less expensively and still protect building surfaces.

BRIEF SUMMARY OF THE INVENTION

Briefly described, in its preferred form, the present invention comprises an entryway protector for use with elevator door jamb panels and facer panels to protect the surfaces of these panels from sustaining damage from collisions with moving equipment, building materials and furniture. The entryway protector is placed adjacent to the elevator door jamb panels and facer panels and attached by a securing device. The entryway protector protects the surfaces from scratches and dents when furniture and construction material inadvertently bang into these protected surfaces.

The present entryway protector is a barrier-type device that a landlord or property manager can quickly and easily install to protect the elevator door jamb panels and facer panels from scratches and dents.

The invention comprises a main section, angled guide section, and minor section. This entryway protector is constructed of a material with sufficient rigidity to maintain the shape of the protector when in position for protecting the surfaces of an elevator entryway. A suitable material has been found to be polyvinyl chloride. The angled guide section is attached to the main section at an acute angle so that the front edge of the angle guide section is nearer the surface of the entryway when in position so as to guide objects removed from the elevator to the main section. The front edge of the angle guide section is placed near an elevator door. The minor section is attached to the main section basically a right angle to protect the facer panel of the elevator door jamb panel. The angled guide section basically guides objects being moved through the entryway from the elevator to the main section of the entryway protector. The entryway protector can be attached to the elevator doorjamb panels by suction cups which will not damage the door jamb panel. This permits easy installation of the entryway protector and also easy removal.

Preferably the entryway protector is made with a height of about 40 inches, so that it can be easily shipped. In this case two protectors will be needed for each elevator door jamb panel. They can be secured together by an H clamp or other suitable securing means.

Other features of the present invention include its economical cost, its ease of carrying, its ease of putting into position to protect the elevator door jamb panels and easy removal. Further, unlike furniture pads, the present invention remains in the upright position so the protection device does not crumple to the floor. In order to use furniture pads to protect the hallway walls, hanging attachments must be secured into the wall, which attachments necessarily damage the wall. Conversely, the present invention is noninvasive.

Thus, it is an object of the present invention to provide a lightweight, portable and inexpensive protection device to protect wall and door surfaces from collision with furniture, moving equipment and construction materials.

It is another object of the present invention to provide a protection device that can be easily moved and placed in position by one individual.

These and other objects, features and advantages of the present invention will become more apparent upon reading the following specification in conjunction with the accompanying drawing figures.

DETAILED DESCRIPTION OF A PREFERRED EMBODIMENT

Figure 1:
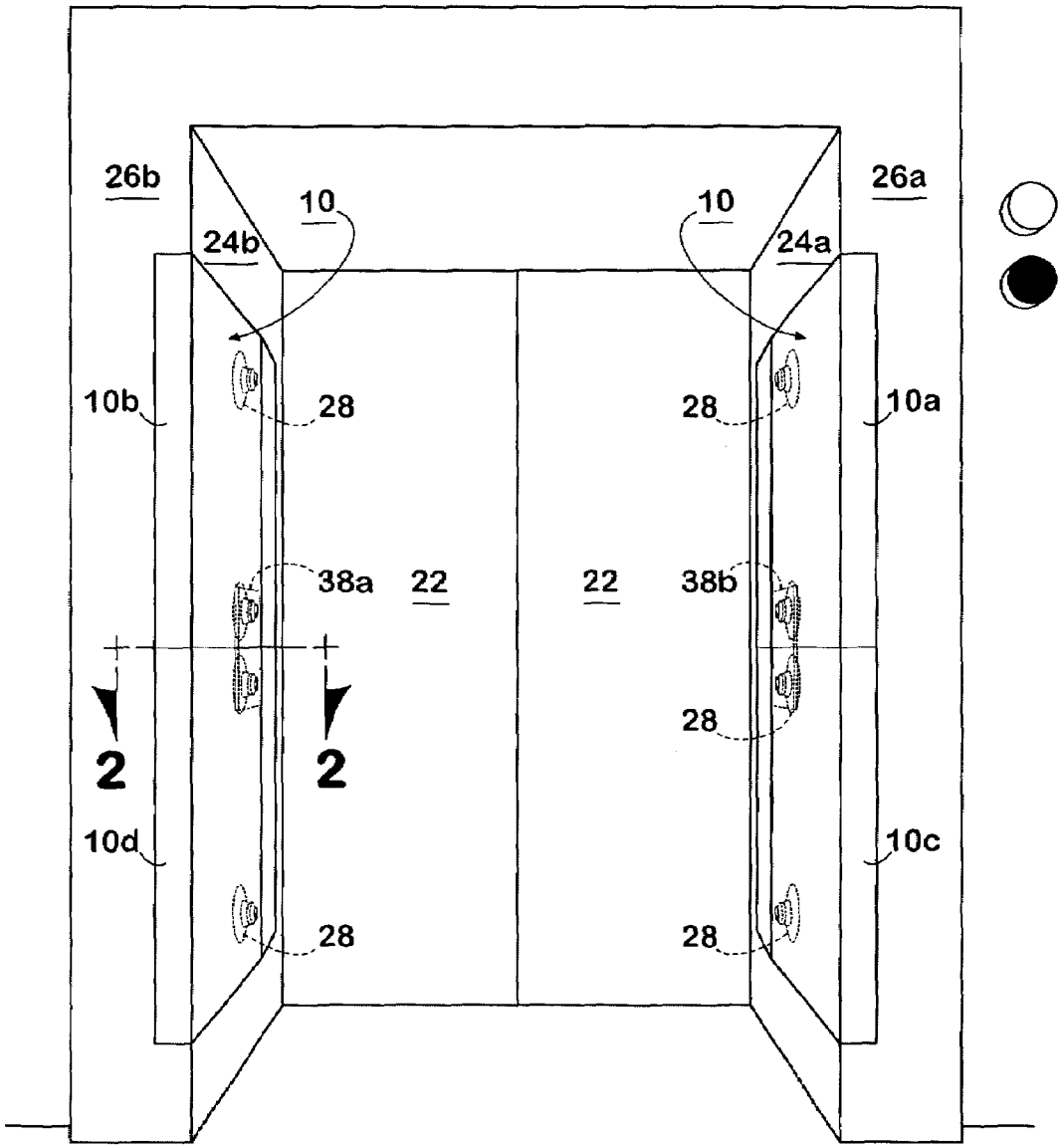
FIG. 1 is a front view of an elevator door with a door jamb on each side upon which two entryway protectors are installed on each door jamb.
Figure 2:
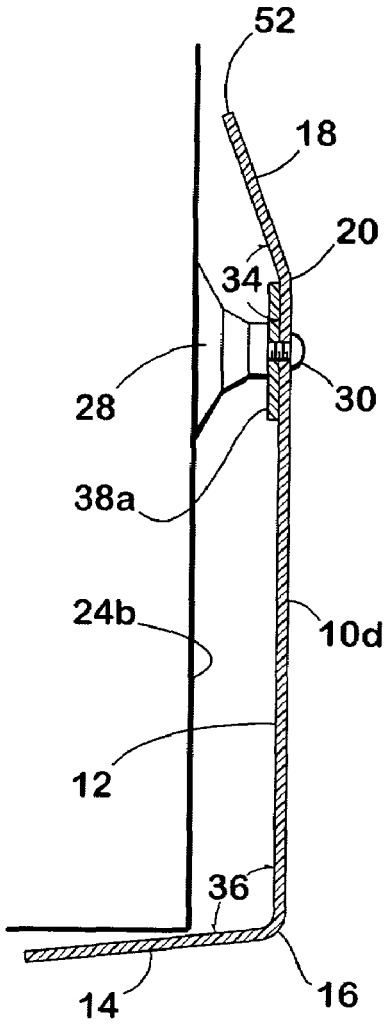
FIG. 2 is cross-sectional view taken along line 2-2 between a top and bottom entryway protector installed on a door jamb to an elevator.
Figure 3:
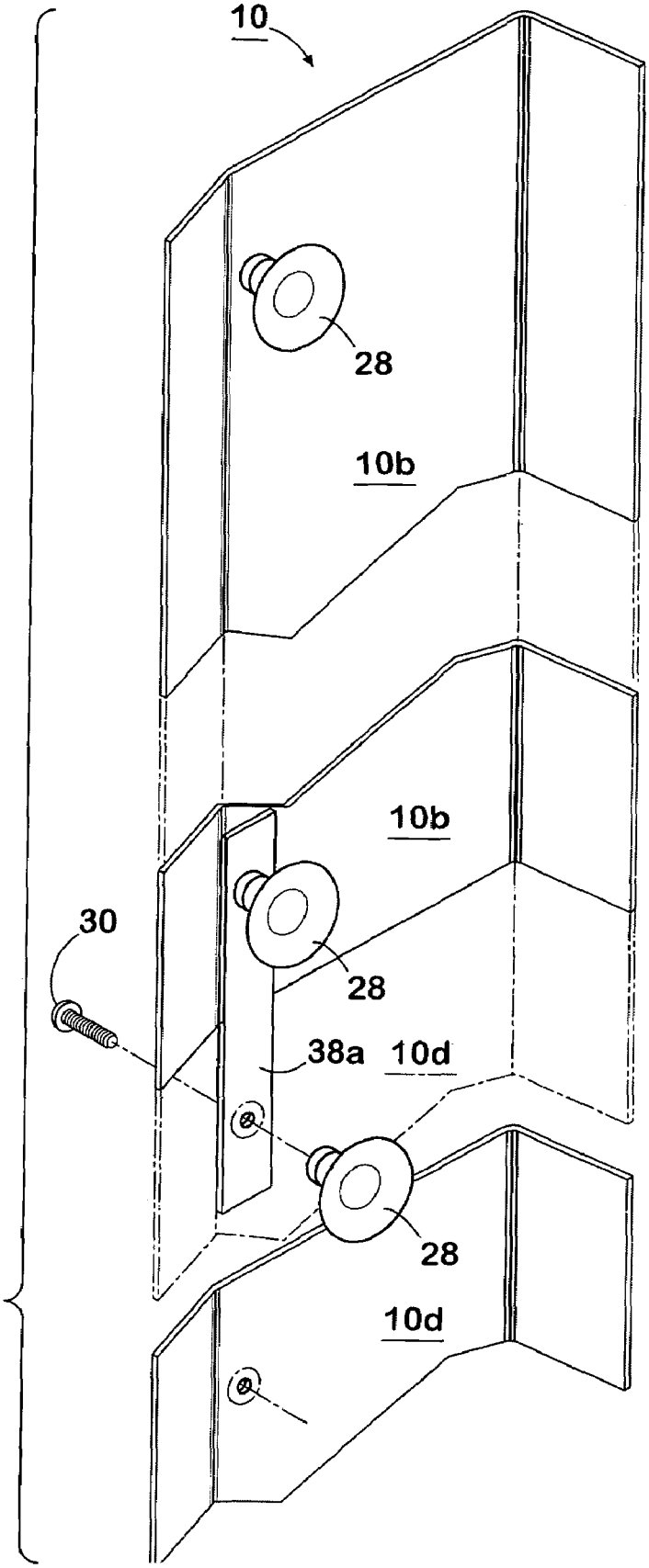
FIG. 3 is a backside view of a top and bottom entryway protector showing the use of an H clap to attach the protectors together.
Figure 4:
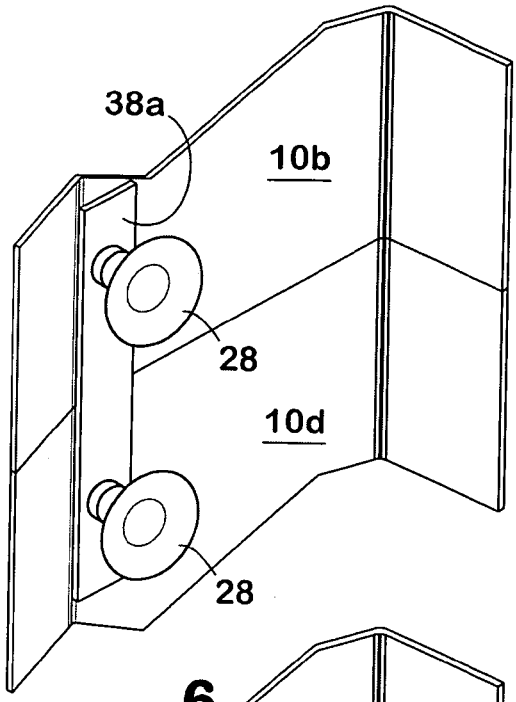
FIG. 4 is a backside view of a top and bottom entryway protector clamped together by an H clamp.

Referring now in detail to drawing figures, wherein like reference numerals represent like parts throughout the several views, FIG. 1 shows a front view of a preferred embodiment of an elevator doorway protected by two entryway protectors 10*a-d* on each elevator door jamb panel 24*a-b*. A top sectional view 2-2 of entryway protector 10*d* is shown in FIG. 2. Preferably the entryway protector 10*d* comprises a main section 12, a minor section 14 and an angled guide 18. The entryway protector 10*d* is attached to the elevator doorway by securing components. In this case, a suction cup 28 is attached to the main section 12 by a bolt 30. Suction cup 28 is secured to the elevator door jamb panel 24*b* by pressing it against the panel in the conventional way in which suction cups are attached. The suction cup may be wetted or a quick release adhesive applied to secure it to the elevator doorjamb panel 24*b*. It should be realized that other means can be used to keep the entryway protector 10*d* in position during the movement of objects in and out of the elevator through the elevator doors 22.

The angled guide 18 is attached to the main section 12 at an acute angle 34 so that the front edge 52 of the angled guide 18 is close to the elevator door jamb panel 24*b*. This provides a guide, like a funnel, so that objects do not get caught on the front edge 52 of the angled guide 18. If an object is being moved out of the elevator and it hits the angled guide 18, the object will be guided to the main section 12 and not hit the elevator door jamb panel 24*b*.

In a similar fashion the minor section 14 is attached to the main section 12 at an angle which may be a right angle 36. The exact angle of attachment will depend upon the angle at which the elevator door jamb panel 24*b* meets the elevator door jamb panel facer panel 26*b*. In most cases that will be a right angle.

Figure 5:
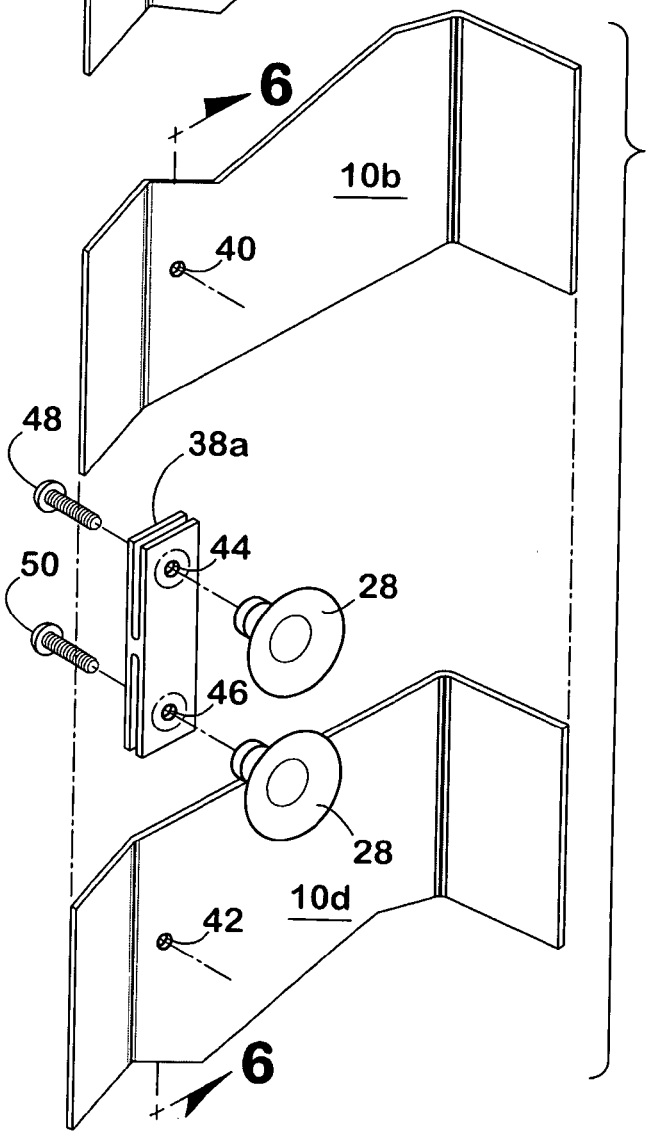
FIG. 5 is a backside view of a top and bottom entryway protector showing the H clamp in position to be installed on the two protectors.
Figure 6:
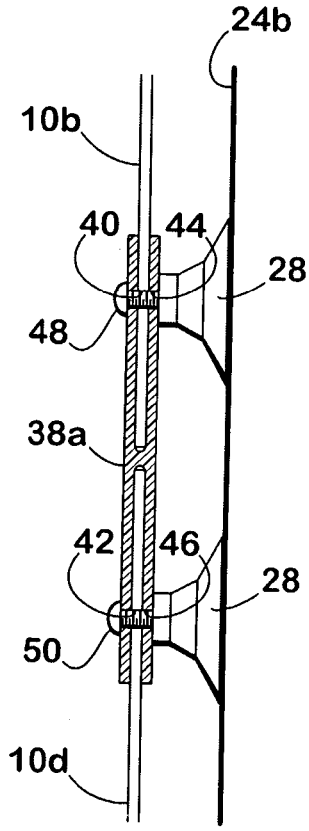
FIG. 6 is a vertical section view showing a suction cup attached to the top and a suction cup attached to the bottom entryway protector with the cups adhered to an elevator door jamb.

Preferably, the entryway protector 10*a-d* is made from a single sheet of material. The material needs to have sufficient rigidity to protect the elevator door jamb panel 24*a-b* from damage by objects being moved in and out of the elevator through doors 22. The entryway protector 10*a-d* also needs to have sufficient rigidity so that it will stay in position when attached to the elevator door jamb panel 24*a-b* by suction cups 28. One suitable material of which the entryway protector 10*a-d* can be constructed is polyvinyl chloride. However, it should be understood that the entryway protector 10*a-d* could be constructed of wood or another type of plastic. A corrugated plastic such as Corrplas® may be utilized. The entryway protector 10*a-b* can be bent to form the acute angle 34 between the main section 12 and the angled guide 18 and the right angle 36 between the main section 12 and minor section 14. It will be realized that the angled guide 18 and minor section 14 could be separate pieces that are attached by suitable means to the main section 12. However, it is preferred that the entryway protector 10*a-d* be formed from a single sheet of material. Entryway protectors 10*a-d* are illustrated in FIG. 1 with two entryway protectors protecting each elevator door jamb panel 24*a* and 24*b* and elevator door jamb facer panel 26*a-b*. It should be realized that a single entryway protector could be used to protect each elevator door jamb panel 24*a-b* and elevator door jamb facer panel 26*a-b*. It is preferable to have two entryway protectors protecting each elevator door jamb panel, as illustrated by 10*a* and 10*c* protecting elevator door jamb panel 24*a* and elevator jamb facer panel 26*a*. It is preferable to have the entryway protector 10*a-d* be approximately 40 inches in height to facilitate shipment by a rapid shipment service. In order to do this it is necessary to have a means of attaching two entryway protectors 10*a* and 10*c* together to protect one elevator door jamb panel 24*a* and elevator door jamb facer panel 26*a*. These two entryway protectors 10*a* and 10*c* can be attached together by any suitable means. One method is to use an H clamp 38*a-b* as best shown in FIGS. 1 and 5. The H clamp has two holes 44 and 46 through which bolts 48 and 50 are extended respectively. Holes 44 and 46 are aligned with corresponding holes

40 and 42 in the entryway protectors that are being aligned together, in this case 10*b* and 10*d*. Preferably two H clamps 38 are used to fix two entryway protectors, in this case 10*b* and 10*d* together.

The entryway protector 10*a-d* is especially useful in protecting the elevator door jamb panel 24-*b* and elevator door jamb facer panel 26*a-b*. The elevator door jamb panels 24*a-d* span the set back depth of the elevator doors from the hallway wall. These elevator jamb panels are especially prone to damage from moving objects in and out of elevator. The depth of the elevator jamb panels is typically either seven inches or fourteen inches with basically needs to be the approximate length from the front edge 52 of the angled guide 18 to the corner 16 between the main section 12 and minor section 14. This length can be somewhat less than the seven or fourteen inches but needs to be sufficient to protect the elevator door jamb panel. The length of the minor section 14 only needs to be sufficient to extend along part of the elevator door jamb facer panel 26*a-b* to protect it from damage.

The entryway protectors 10*a-d* can be easily assembled and installed in place by securing the H clamp 38 between two entryway protectors 10*b* and 10*d* as shown in FIG. 5. The suction cups 28 can then be pressed against the elevator door jamb panel 24*b* and secure it. Preferably two of the H clamps 38 would be used to secure the entryway protectors 10*b* and 10*d* together with two suction cups on each H clamp 38. Once the H clamps 38 have been installed between two entryway protectors 10*b* and 10*d* they can remain in place with the combined entryway protectors 10*b* and 10*d* remaining attached and moved as a single protector from elevator to elevator and building to building.

While suction cups are the preferred method of attachment of the entryway protector 10*a-d*, it should be realized that other means of holding the entryway protector in position can be utilized. The suction cups 28 are preferred because they do not involve placing any holes in the elevator door jamb panels or elevator door jamb facer panels. Other types of securing means, such as putting a supporting base on the bottom of an entryway protector 10*a-b*, could be utilized. Of course, a predrilled hole could be provided in the elevator door jamb panel with the entryway protector simply held in position by bolts that are secured to these holes.

This entryway protector can be used to protect other types of entryways other than those to elevators. It could for example be used to protect the hallway and jamb panel of an ordinary door. The entryway protector 10*a-d* can easily be hung by one by individual without in any way damaging the hallway, wall or the elevator door jamb panel when suction cups are used.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

Therefore, having thus described the invention, at least the following is claimed:

1. A portable device for protecting the surfaces of an elevator entryway from moving objects there through, the entryway having a first and a second surface on each side of the entryway with the first surface being adjacent the elevator and the second surface being adjacent the first surface and remote from the elevator, the device comprising:

(a) a main section, an angled guide section, and a minor section, the device being constructed of a material with sufficient rigidity to maintain the shape of the portable device when in position for protecting the surfaces of an elevator entryway, said angled guide section having a front edge and back which is attached at its back to the main section so that the front edge of the angled guide section is adjacent the elevator when the portable device is in position for protecting the surfaces of an elevator entryway, with the angled guide section being attached to the main section at an acute angle so that the front edge of the angled guide section is nearer the first surface of the entryway when in position in the entryway so as to guide objects being moved through entryway to main section, the minor section being attached at an angle to the main section so as to be in juxtaposition to the second surface of the elevator entryway, said portable device being designed to be placed immediately adjacent an elevator entryway with the main section and angled section being immediately adjacent to the first surface of the elevator entryway so as to protect the first surface of the elevator entryway from any moving object to restrain penetration of the portable device, said minor section being designed to protect the second surface of the elevator entryway from any moving object, said minor section having a width such that it is capable of protecting a distance of the width of the second surface, said material of which the main section, angled guide section, and minor section is constructed being designed to absorb the force exerted by the moving object; and (b) a noninvasive securing system capable of securing the entryway protector to the surfaces to be protected which comprises at least one suction cup attached to the device for temporary attachment by suction to a surface of the elevator entryway, wherein the suction cup is attached by a fastener extending through a hole in the device and threaded into the suction cup and through a hole in at least one plate, the plate being sandwiched between the device and the suction cup, the plate in linear alignment proximate to the angled guide and proximate the edge of the main section.

2. The portable device of claim 1 in which the noninvasive securing system comprises at least two spaced apart suction cups attached to the main section for temporary attachment by suction to the first surface of an elevator entryway.

3. A portable device for protecting the surfaces of an elevator entryway from moving objects there through, the entryway having a first and a second surface on each side of the entryway with the first surface being adjacent the elevator and the second surface being adjacent the first surface and remote from the elevator, the device comprising:

(a) two protection elements, each of which has a main section, an angled guide section, and a minor section, the device being constructed of a material with sufficient rigidity to maintain the shape of the portable device when in position for protecting the surfaces of an elevator entryway, said angled guide section having a front edge and back which is attached at its back to the main section so that the front edge of the angled guide section is adjacent the elevator when the portable device is in position for protecting the surfaces of an elevator entryway, with the angled guide section being attached to the main section at an acute angle so that the front edge of the angled guide section is nearer the first surface of the entryway when in position in the entryway so as to guide objects being moved through entryway to main section, the minor section being attached at an angle to the main section so as to be in juxtaposition to the second surface of the elevator entryway, said portable device being designed to be placed immediately adjacent an elevator entryway with the main section and angled section being immediately adjacent to the first surface of the elevator entryway so as to protect the first surface of the elevator entryway from any moving object to restrain penetration of the portable device, said minor section being designed to protect the second surface of the elevator entryway from any moving object, said minor section having a width such that it is capable of protecting a distance of the width of the second surface, said material of which the main section, angled guide section, and minor section is constructed being designed to absorb the force exerted by the moving object, with each protection element having a top and bottom edge, with elements being arranged with the bottom edge of one element in juxtaposition with the top edge of the other protection element;

(b) said protection elements being held together by securing means; and (c) said portable device being held in position to the surfaces to be protected by a noninvasive securing system which comprises at least one suction cup attached to the device for temporary attachment by suction to a surface of the elevator entryway, wherein the suction cup is attached by a fastener extending through a hole in the device and threaded into the suction cup and through a hole in at least one plate, the plate being sandwiched between the device and the suction cup, the plate in linear alignment proximate to the angled guide and proximate the edge of the main section.

4. The portable device of claim 3 in which the noninvasive securing system comprises two spaced apart suction cups attached to the main section for temporary attachment by suction to a surface of the elevator entryway.

5. The portable device of claim 3 in which the protection elements are held together by at least one H clamp holding the bottom edge of the top protection element to the top edge of the bottom element and in which the noninvasive securing system comprises at least two spaced apart suction cups attached to a main section for temporary attachment by suction to a surface of the elevator entryway.

* * * * *